United States Patent [19]

Parker

[11] Patent Number: 4,732,355

[45] Date of Patent: Mar. 22, 1988

[54] RATE CODE DECODING SYSTEM

[75] Inventor: John W. Parker, Rochester, N.Y.

[73] Assignee: General Signal Corporation, Stamford, Conn.

[21] Appl. No.: 817,309

[22] Filed: Jan. 9, 1986

[51] Int. Cl.[4] ..... B60L 15/06; H01H 47/20

[52] U.S. Cl. ..... 246/34 R; 246/34 B; 246/182 R; 375/96; 329/104

[58] Field of Search ..... 246/182 R, 187 A, 34 R, 246/34 B; 375/96, 103; 455/303; 364/572, 724, 728, 819, 825; 329/104, 107, 50

[56] References Cited

U.S. PATENT DOCUMENTS

| | | | |
|---|---|---|---|
| 2,731,552 | 1/1956 | Kendall et al. | 246/182 R |
| 3,493,876 | 2/1970 | Zimmerman | 375/96 |
| 3,522,541 | 8/1970 | Gooding | 375/96 |
| 3,626,373 | 12/1971 | Wilcox | 340/825.71 |
| 3,715,579 | 2/1973 | Eblovi | 246/187 A |
| 3,792,364 | 2/1974 | Ananias | 329/104 |
| 4,019,149 | 4/1977 | Kustka et al. | 375/96 |
| 4,307,463 | 12/1981 | Sibley | 371/14 |
| 4,333,150 | 6/1982 | Matty et al. | 364/728 |

*Primary Examiner*—John W. Caldwell, Sr.
*Assistant Examiner*—Alvin Oberley
*Attorney, Agent, or Firm*—Ronald Reichman; Martin LuKacher

[57] ABSTRACT

In railway signaling systems which transmit rate code signals along track circuits, which signals are picked up by the trains and used for signaling purposes, such as speed control, the rate code signals of the same repetition rate received when the train passes between adjacent track section may suffer a phase shift, also known as a phase jump. To prevent loss of the rate code signal during a phase jump, an improved rate code decoding system is provided wherein a correlation process is applied to the received rate code signal by multiplying the signal in separate multipliers with reference signals which are in quadrature and then cross-correlating the output of the multipliers with a step function and summing the absolute values of the outputs of the cross-correlators to provide a level which is substantially constant in the presence of a phase jump. The cross-correlation system provides a filter with a response which is effectively rectified by removing the notch which otherwise would result in the presence of a phase jump. The system may include means for decreasing the time required for the system to acquire the rate code signal when it first appears and in the presence of multiple phase jumps which occur in rapid succession. The system is especially suitable for use in railroads having short track circuits subject to phase jumps in the received rate code signals, for example, when the train travels along the tracks at high speeds.

6 Claims, 8 Drawing Figures

RATE CODE DECODING SYSTEM

DESCRIPTION

The present invention relates to a rate code decoding system which is useful in detecting rate code signals which are transmitted along the track circuits of a railway signaling system, and particularly to a system for detecting, by effectively filtering, a repetitive signal, which system is insensitive to phase shifts in such signals, including phase jumps which may occur as the signals are received and which may appear as dropouts or extraneous signals. Rate code signals are typical of the type of signals which may be detected or filtered by a phase insensitive filtering system embodying the invention.

The invention is especially suitable for use in railway signaling systems wherein a train travelling along the tracks receives rate code signals transmitted along the tracks and appear on adjacent track circuits. Because the code transmitters are not synchronized, a phase jump in the rate code signals can occur as the train passes between adjacent track circuits. The phase shifts during these jumps can be of any magnitude between −180° and +180°. The phase jumps can result in dropouts in the detected rate code signal which can interfere with the proper operation of the signaling system. The problem is exacerbated when the track circuits are very short, as by utilizing short sections of tracks perhaps 50 meters or less in length. Then, phase jumps can occur very quickly and prevent the acquisition of the rate code signal by the train. Since rate code signals are used for train speed control, it is important that such signals be acquired quickly and not lost due to phase jumps. The present invention provides a phase insensitive detector or filter system which accepts the rate code signal and does not lose the signal in spite of phase shifts and phase jumps, including phase jumps in the rate code signals which occur in rapid succession, as when a high-speed train moves through short track circuits.

The phase insensitive filter system provided by the invention may have other applications wherever phase shifts or jumps in a signal preclude continuous and proper filtering thereof.

Rate code signals have been used in railway signaling systems for some time. Approximately six different rate codes may be transmitted along the track circuits. Some systems use up to twelve rate codes. For detecting each of such rate codes, different filters have been used. Such filters may be conventional filters utilizing lumped inductive and capacitive elements, or active, operational amplifier filters or digital filters. Reference may be had to the following patents for further information concerning rate code signaling systems: Kendall et al, U.S. Pat. Nos. 2,731,552 issued Jan. 17, 1956; Wilcox, 3,626,373 issued Dec. 7, 1971; Eblovi, 3,715,579 issued Feb. 6, 1973 and Sibley, 4,307,463 issued Dec. 22, 1981. In such systems the problems of phase shifts and jumps have been overcome by utilizing a timer circuit which prevents pickup of the relay, which generates the control signal, for a period of time after a phase jump and which precludes the drop out of the relay for a predetermined time after occurrence of a phase jump. Such circuits are satisfactory in cases where the track circuits are long. For short track circuits, phase jumps can occur in rapid succession. It is desirable to improve the acquisition of the code rate and the pickup of the relay which produces the control signal in the presence of phase jumps. It is also desirable to improve operation where phase jumps in rapid succession and provide greater assurance of maintaining the control signal. It is also undesirable, because of the large amount of work and cost to modify the track circuits to provide synchronism between the code rate signals in adjacent track circuits so as to prevent the occurrence of phase shifts and jumps in the rate code signals as they are detected by the passing trains.

The code rates are of low frequency approximately 1–20 Hertz (Hz). The signals are subject to low frequency noise and selective filters are needed for reliable detection. The phase insensitive filter system provided by the invention retains the requisite noise immunity while also providing immunity against phase jumps.

Accordingly, it is the principal object of the present invention to provide an improved rate code detection system for use in railway signaling which incorporates an improved phase insensitive filter system and is not adversely affected by phase shifts and phase jumps in the rate code signals, and also provides selectivity for the various rate codes.

It is another object of the present invention to provide an improved phase insensitive filter system which maintains its output in response to input signals in spite of phase shifts and phase jumps therein.

It is a still further object of the present invention to provide an improved rate code detection system which operates rapidly to acquire new rate code signals, as where the code rate changes or in the presence of phase shifts and phase jumps in the signal.

It is a still further object of the present invention to provide an improved rate code detection system which may be implemented using digital data processing techniques for digital filters and correlators for the phase insensitive filtering and detection of such signals.

A separate rate code detection system including phase insensitive filters is provided in accordance with the invention for each code rate which is to be detected. The description herein refers to one of such systems and it will be appreciated that a separate system is provided for each code rate.

The system provided by the invention utilizes correlation means for acquiring the rate code signal. Such correlation means, which may be contemplated as a correlation filter, compares the input signal with two reference signals at the code rate. All signals may be transmitted as a carrier in bursts at the code rate. The input signals may be square waves at the code rate which is to be detected, obtained upon demodulation of the carrier bursts. The local reference signals are in quadrature with each other (90° out of phase). Each reference signal is multiplied with the input signal. Digital multiplication may be carried out over N cycles of the incoming rate code signal wave form. N cycles may suitably be 8 cycles of the rate code signal. The signals are preferably sampled; for example, using eight samples for each cycle of the rate code signal. The samples are stored in buffers which store eight or sixteen cycles of samples so as to yield the desired frequency response. N cycles of the incoming wave are multiplied with N cycles of each of the reference signals. The absolute values of the two products are added to obtain the output product number that represents the signal level. The value of N determines the filter response time and band width. As N is made larger, the filter becomes slower and more selective. The correlation means processes the absolute values before they are added so that the filter becomes tolerant of phase shifts and phase jumps because of the way in which the absolute sums of the two products add.

For any input signal that has been stable (no phase jumps) for at least N cycles, these sums are constant, regardless of the phase of the signal. If the signal is exactly in phase or exactly 180° out of phase with one of the two local, reference signals, the absolute value of each product will be 1 (given that the input and reference signals are bi-level signals with amplitudes of +1 and −1). In this case the product of the input signal and the other local, reference signal will be zero and the sum will be 1. For differences in phase of the input and local signals between 0° and 90°, the absolute values of both products will be less than 1. The sum, however, will remain at one.

For small phase jumps, such that the signs of neither product changes as the value of the product varies during the phase jump, from original to new values, the absolute value of the two products will change in different senses at the same rate. One increases while the other decreases. Hence, the sum will remain constant and unaffected by the phase jump. If either of the products changes sign during the transition, its absolute value will drop to zero during the transition and the sum of the two products will not remain constant. Therefore, the correlation of the input, rate code signal with the local, reference signals which are in quadrature will not remain constant and the filter will experience a drop out during the phase jump.

The present invention overcomes this problem by processing the correlation products from the multipliers before the products are summed by cross-correlating each product separately with a step function. This cross-correlation effectively rectifies the response characteristic of the filter, such that when the cross-correlation outputs are added together, the result is constant during a phase jump. A phase insensitive decoding and filtering system is then provided.

The way in which cross-correlation with a step function overcomes the phase jump induced dropout may be more clearly understood by considering how the products of the input rate code signals and the reference signals are obtained. These products are each obtained by comparing equal durations of the signal and the local reference wave forms. For each instant of the duration interval, the instantaneous product is the product of the instantaneous values of the input signal and the reference wave forms at that instant. The overall product, therefore, is a wave form of the same duration. The product value over the N cycles, is the average value of this wave form.

The processing of the product absolute values (i.e., the cross-correlation with the step function) is implemented by determining a series of averages from the products and extracting the highest value obtained. In the cross-correlation processing, the first value is obtained by averaging the product wave form as initially determined. The next value is obtained by inverting a small portion of the product wave form at one end thereof, and then taking the average. The third value is obtained with a little more of the wave form inverted. This process continues, each time with more of the wave form inverted, until finally the entire product wave form is inverted. At the point in this process where all of the wave form on one side of the phase jump has been inverted, while the portion of the wave form on the other side of the phase jump has not been inverted, an average value that would have gone from one sign to the other sign as a result of the phase jump (and would have resulted in the dropout) now remains of the same sign. The same processing is applied to the other product wave form (the product of the input signal with the quadrature related reference signal). The sum of the absolute values of the two products then always remains substantially constant at 1, regardless of the amount of the phase jump. In this way, insensitivity to any single phase jump of the input code rates signal is obtained.

In the event that an output of the decoding system using the correlation means as described above is required in a shorter time than the duration of N cycles of the input rate code signal, for example, 4 cycles rather than 8 cycles. The system may be provided with a conventional filter, such as a digital filter, tuned to the rate code, which itself is phase shift and phase jump sensitive, to rapidly acquire the signal and also to determine when the input rate code signal is no longer present. Means are provided, such as a buffer which stores the initial and recent cycles of the incoming rate code signal. When the conventional filter acquires the signal, an N cycle replica of the received rate code signal is reconstructed, utilizing the most recent cycles. The reconstructed or replica signal is used for operating the correlator. As new cycles of the actual input signal are received, they are continuously added, in the reconstruction buffer, to one end of the replica and the equivalent amount is deleted from the other end of the replica. The system therefore maintains the noise in-sensitivity of the correlation filter as well as fast, and frequency selective operation.

The conventional filter also accommodates rapidly reoccurring phase jumps, for example, when a second phase jump occurs within the duration of the N cycles of the rate code signal. As soon as the conventional filter reaches a threshold level after the first phase jump, it causes the buffer to reconstruct the N cycle replica of the actual input signal before the second phase jump can affect the process, and utilizes that replica. Therefore, the correlation filter sees only single phase jumps. The conventional filter may also be used to inhibit the relay which picks up in response to the output of the correlation filter and produces the control signal which represents the detection of the rate code.

The foregoing and other objects, features and advantages of the invention as well as a presently preferred embodiment thereof, will become more apparent from a reading of the following description in connection with the accompanying drawings in which.

Figure 1:
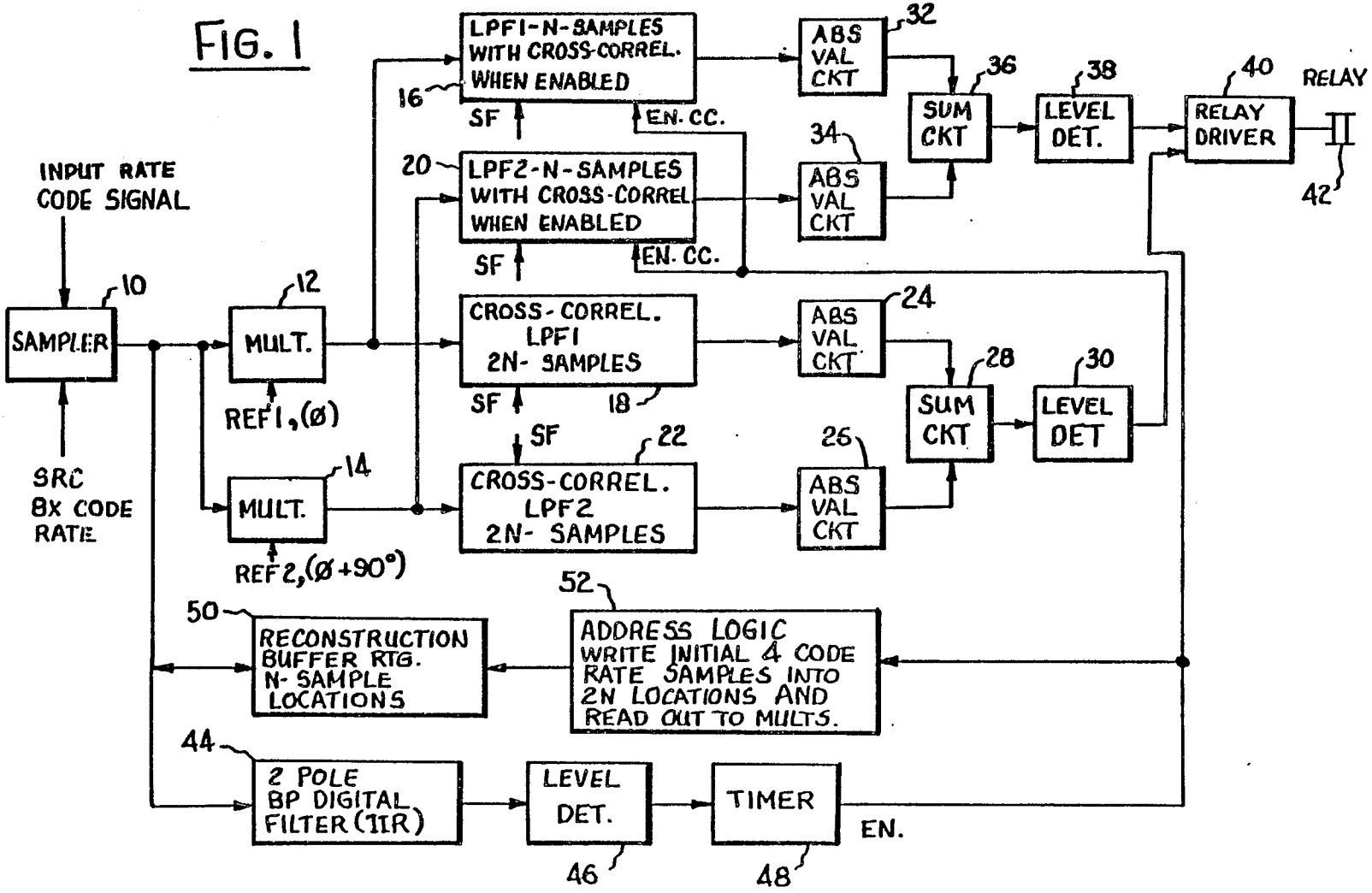
FIG. 1 is a block diagram of a rate code decoding system embodying the invention.

Referring to FIG. 1, which is a block diagram of the complete rate code decoding system, the input to the system is the rate code signal, which may be picked up from the tracks by the train pickup coil and which has been passed through a carrier filter as includes an envelope detector and a shaping circuit to provide square wave pulses. This input signal is applied to a sampler 10. Sampling is done at a faster rate, suitably eight times the code rate which the system, as shown in FIG. 1, is designed to detect. It will be recalled that the system shown in FIG. 1 is replicated for each code rate. Thus, for the usual 6 different code rates, there are 6 such systems.

The samples are applied to digital multipliers 12 and 14 where they are multiplied with quadrature-related reference signals. These are also square waves of the same code rate as the input signal. REF1 is at relative 0°, but while REF2 is at 90° to REF1. The product outputs of the multipliers are applied to two sets of cross-correlation low pass filters. The product output of multiplier 12 is applied to a filter 16 of one of the sets and a filter 18 of the other set. The product outputs of the other multiplier 14 are applied to a filter 20 of one of the sets and a filter 22 of the other set. The filters 16 and 20 are designed to handle N samples or signal elements, for example, from eight cycles of the rate code signal. The filters 18 and 22 are designed to handle twice the number of samples or signal elements, or 2N samples. For a sampling rate of eight times the code rate, and where N is eight cycles of the rate code signal, the filters 16 and 20 handle 64 samples while the filters 18 and 22 handle 128 samples. These filters may be implemented by buffers which may be provided by sections of the memory in a microprocessor.

The 2N sample filters 18 and 22 operate continuously as cross-correlation low pass filters and cross-correlate the rate code signals stored therein with a step function indicated as SF. The N sample filters are used as cross-correlation filters only when the sum of the absolute value of the N samples in the filters provided by the 2N sample filters, when cross-correlated with the step function is above a pre-determined threshold level. Then, the N sample low pass filters 16 and 20 are enabled to operate as cross-correlation filters, and cross-correlate the samples stored therein with the step function SF.

Absolute value circuits 24 and 26 are shown connected to the output of the 2N sample low pass filters 18 and 22 to represent that the absolute values of the sum of the 2N samples stored therein are used and applied to the sum circuit 28. When the number in the sum circuit exceeds the threshold level, a level detector 30 provides an enabling signal which enables cross-correlation in the N sample low pass filters 16 and 20. This technique permits the cross-correlation filtering to be carried out at an N sample rate but only during the more selective narrower band width which is provided by the larger number of samples in the filters 18 and 20. Thus, the filtering system is provided with greater selectivity as well as the faster operation commensurate with the use of N samples rather than 2N samples. The N sample low pass filters 16 and 20 have their absolute values taken by absolute value circuits 32 and 34, and the outputs are summed in a sum circuit 36. When the sum is above a pre-determined threshold, which indicates that the input rate code signal has been detected, a level detector 38 provides an output to a relay driver 40 which causes a relay 42 to pick up. When the relay picks up, it generates a control signal (a closed contact condition where current flows). This control signal then signals the train that the code rate has been detected and that the train may operate at the speed dictated by the code rate.

Figure 3:
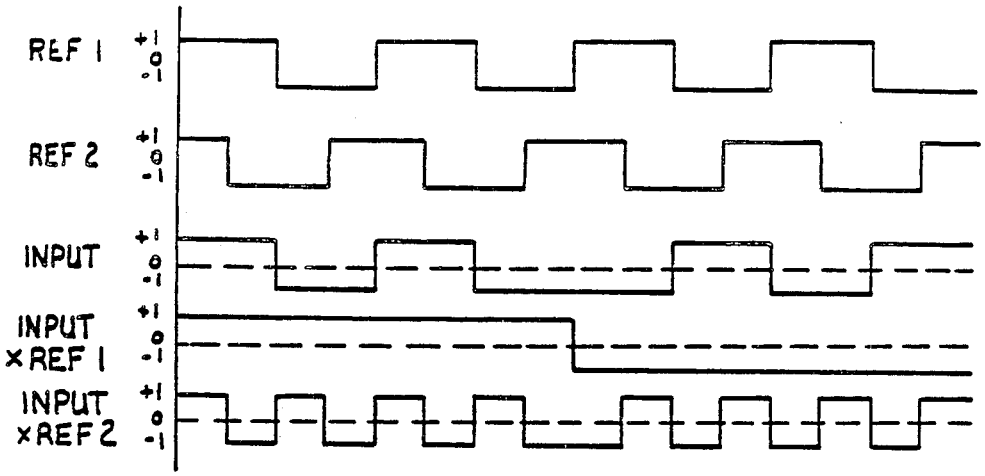
FIG. 3 are wave forms illustrating the input code rate signals, the reference signals and the multiplier outputs during a 180° phase jump.
Figure 4:
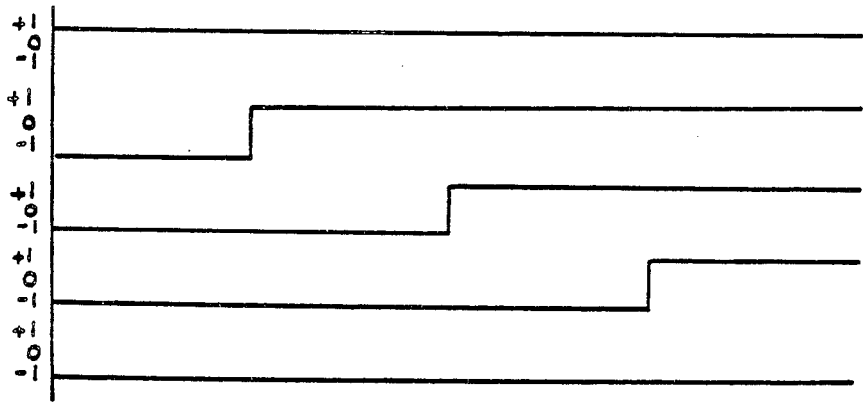
FIG. 4 are diagrams illustrating the contents of the buffer in the cross-correlation low pass filter (four cycles in length at five times-before the phase jump (top) one cycle later (second down), two cycles later (third down) etc., (LPF) for the product of the input and the REFI, reference signal of zero relative phase.
Figure 5:
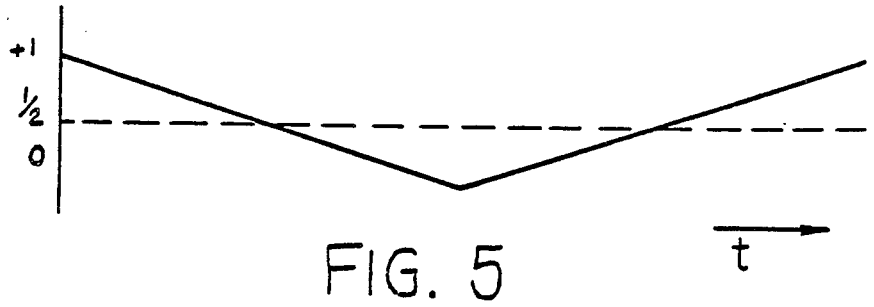
FIG. 5 is the response of the filter, namely the output of the sum circuit during a 180° phase jump when cross-correlation pre-processing in the cross-correlation low pass filters is not utilized.

The operation of the cross-correlation filters having N samples and the effect thereof will become more apparent from the following discussion. First consider FIG. 3 which shows a 180° phase jump in the input rate code signal. Initially, the average value of the product of the input signal and REF1 is one. Following the phase jump, the average value becomes −1. This is indicated by the fourth wave form which represents Input* REF1. Before the phase jump, the sum of the absolute values of the filter outputs will be one, and after the phase jump, the sum will be one, but during the phase jump, the sum of the absolute values will not be one. This may be seen from FIG. 4 which shows the contents of the buffer (which also may be referred to as window filter buffer), which is part of the N sample low pass filter 16, during the phase jump. The average value of the contents of this buffer is initially one. One cycle later, it is ½. One cycle later it is zero. One cycle later, it is −½. Finally, the average value reaches −1. It will be appreciated that the average value is obtained from the sum of the N samples in the buffer. The wave form stored in the buffer of the N sample low pass filter 20, which receives the Input* REF2 product, is constantly zero. The sum of the absolute values of the signals versus time is, therefore, as shown in FIG. 5.

The source of the problem, as noted above, is that the average value of the filter buffer has changed sign, and since it has changed sign, at some point in time the filter output then has to be zero. However, because the absolute value of the filter output is taken, the sign of the average value ultimately does not matter. It is apparent that under certain conditions, a ±180° phase jump or close to that amount of phase shift in the jump, can cause both the sign and the magnitude of the average value of the product terms to change. The problem is due to the change in sign. The change in sign is compensated for by cross-correlating the N samples in the filter with the step function.

Of course, in the absence of a phase jump, it would be efficient to simply sum the filter buffer contents to obtain the average value of the product of the input and reference signals. In the presence of a phase jump, which causes a sign change in the average value of the buffer contents, it is necessary to compensate for the sign change. The cross-correlation with the step function of the buffer contents compensates for the sign change and makes the filter insensitive to a phase shift or phase jump.

In general, the cross-correlation process involves comparing two signals by placing them side-by-side, multiplying corresponding points on the two signals, and then summing all the product terms. The resulting sum is a measure of the degree to which the two signals match. Utilizing cross-correlation with the step function involves moving the two signals, one of which is the step function, slightly with respect to the other and repeating the multiplication process. This is a measure of the amount of agreement between the signals at each point, or a function of their agreement with respect to their relative positions. The position at which this function is a maximum is the position at which the signal and the step function correlate most closely.

Figure 6:
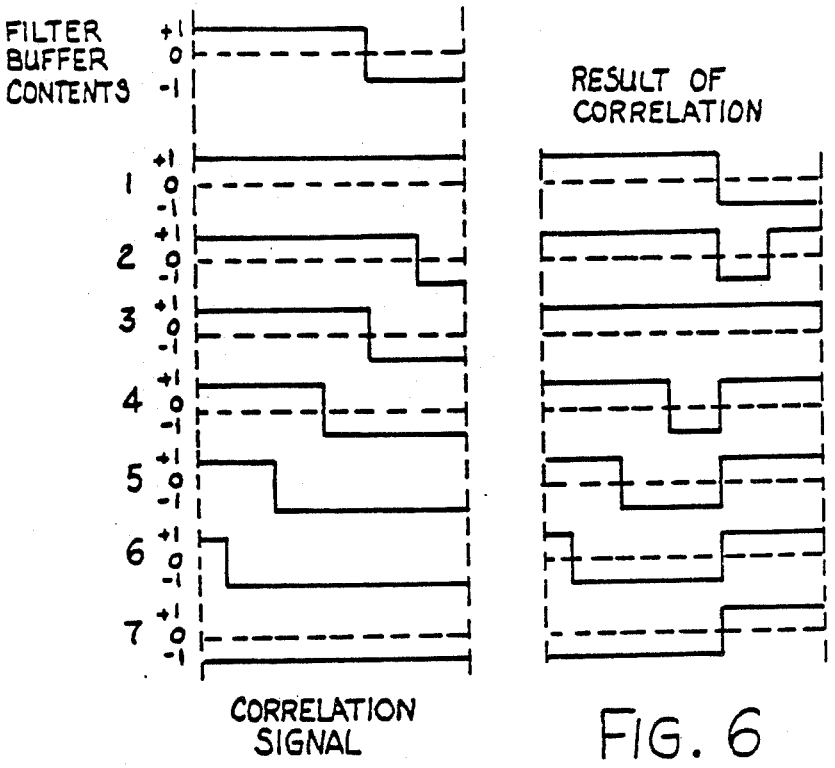
FIG. 6 depicts wave forms illustrating the cross-correlation operations (cross-correlation of the product with a step function) in the cross-correlation low pass filters.

FIG. 6 illustrates an example of the correlation of the signal in the filter buffer with the step function. The exemplary signal which is shown at the top and identified as "filter buffer contents", contains a step from 1 to −1. The step function signal is passed by (traverses) the buffer signal from right to left. Seven positions of the step function correlation signal are illustrated in FIG. 6 below the filter buffer contents signal. To the right of the seven positions are the results of the correlation of the filtered buffer content with the correlation signal in each of the seven positions. This correlation is a point by point multiplication of the correlation signal (the step function) and the filter buffer contents. The signals correlate most closely in step 3 and the resulting summing of the product values is a maximum in step 3. This maximum will be apparent since the average value of the result of correlation in step 3 is one and it is less than one in all of the other steps. The cross-correlation may readily be implemented on a digital basis with a microprocessor. First, consider step 1 in FIG. 6. There, the contents of each element in the buffer is multiplied by one and the resulting products are then summed. This result is the value of the running sum which is maintained in the filter buffer. Next, consider the step function being moved one position to the left. Now every element in the buffer is multiplied by one except for the last, which is multiplied by minus one. The new sum is obtained by taking the previous sum and subtracting the value of the last element to find the sum of the buffer, without the last element, and then subtracting the last element a second time to obtain the new sum with the sign of the last element reversed. This process is equivalent to multiplying the last element by two and subtracting it from the previous value of the sum. Since binary values are involved, the result is obtained directly by observing the sign of the last element, and, accordingly, incrementing or decrementing the previous sum twice. It will be seen that as the step function is shifted again to the left, the sign of the next element is observed and the previous sum is incremented or decremented accordingly. The process continues, generating a new sum for each position in the buffer of the filter, until the effect of a sign reversal on every element in the buffer has been reversed. The maximum correlation between the buffer content and the step function results in the output sum which represents the cross-correlation of the elements (the samples) in the buffer with the step function.

Figure 2:
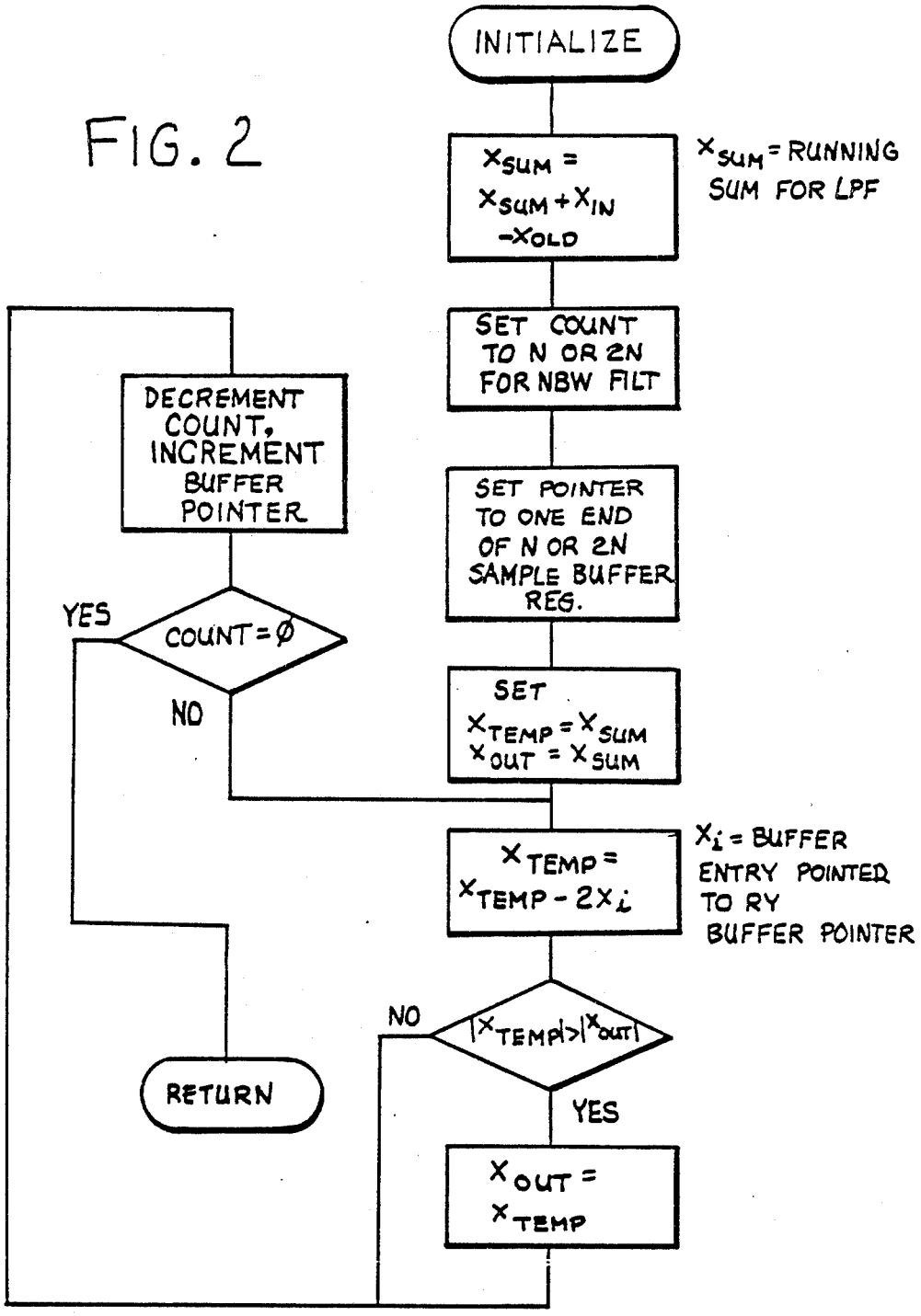
FIG. 2 is a flow chart illustrating the operation of the cross-correlation low pass filter utilized in the system shown in FIG. 1.

The cross-correlation process and the low pass filters with cross-correlation (i.e., the filters 16–22) may all be implemented using a microprocessor. The program for the microprocessor is illustrated in FIG. 2.

When each new sample of the input signal is taken, it is multiplied by the corresponding reference value. This result is $X_{in}$. Before $X_{in}$ can be put into the buffer $X_{old}$ (the least recent entry) is deleted. To keep $X_{sum}$ current, $X_{sum}$ is replaced by $X_{sum}+X_{in}-X_{old}$. Then the two variables $X_{temp}$ and $X_{out}$ are initialized to $X_{sum}$. In the case of the N sample buffers 16 and 20, a count is set to N. The count is set to 2N for the narrow band width 2N sample cross-correlation low pass filters 18 and 22. Then a pointer is set to one end of the N or 2N sample buffers. The value $X_{out}$, as noted above, also represents the running sum. Thus, initially $X_{out}$ as well as $X_{temp}$ are both set to equal $X_{sum}$ (i.e., the running sum).

$X_{temp}$ is then incremented or decremented twice depending upon the sign of the least recent buffer entry. This is the entry $X_i$ which is the buffer entry pointed to by the buffer pointer. The absolute value of this result, the new $X_{temp}$, is compared to the previous maximum absolute value $X_{out}$, and if it is greater, $X_{temp}$ replaces $X_{out}$. The process continues through every element in the buffer as the pointer is decremented at the end, when N or 2N is equal to zero, the maximum value, i.e., the final value of $X_{out}$ corresponds to the maximum correlation between the contents of the filter buffer (all the elements contained therein) and the step function.

This process can be called rectification because it rectifies the filter response curves.

Figure 7:
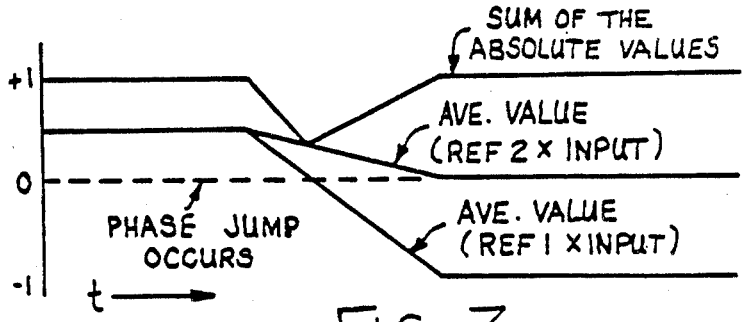
FIG. 7 illustrates the output of the cross-correlation filter as obtained from the sum circuit when cross-correlation pre-processing is not used for the case where the input is 45° out of phase with the references.

FIG. 7 is a plot of the outputs of the filters 16 and 20 and the sum of their absolute values which would be obtained if rectification is not used when a phase jump of 45° occurs. In other words, for the case when the N sample low pass filters 16 and 18 are not operated as cross-correlation filters. Before the phase jump, the output from both filters is ½. Following the phase jump, the first filter begins to ramp down from ½ to −1. The output of the second filter ramps from ½ to zero. The sum of the absolute values initially drops and reaches a minimum, when the first filter output crosses zero. It will, therefore, be apparent that without rectification the cross-correlation filters do not result in a filter system which is insensitive to the phase jump.

Figure 8:
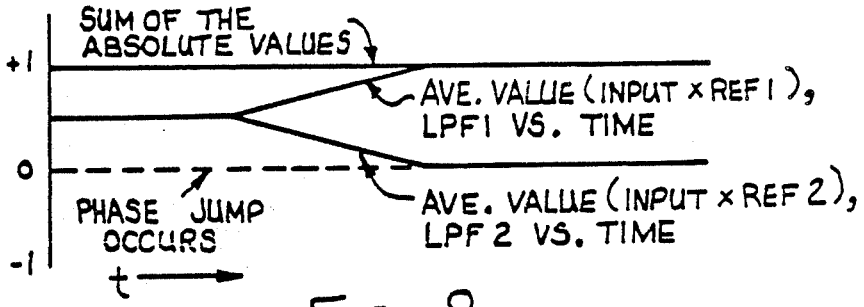
FIG. 8 is a diagram similar to FIG. 7 and for the same case, which illustrates the output from the sum circuit when cross-correlation pre-processing is used therein.

FIG. 8, like FIG. 7, shows what the response of the buffer (the filter) with time looks like. During the interval shown, the contents of the buffer vary. Each time a new sample is taken, the buffer contents are modified and cross correlated with the step function and the maximum value is taken as the filter output ($X_{out}$). Each point on the curve represents output value for LPF1 and LPF2 at a point in time. It will be noted that after the phase jump there will be no sign change so that the rectification process does not result in a greater absolute average value. The output of the filter operating on the product of the input rate code signal and REF1 ramps up from ½ to 1, and the output of the filter from the product of the input signal and REF2 ramps down from ½ to zero. The outputs change at the same rate but in opposite directions. The result is that the sum of the outputs always remains constant at one. The rectification process therefore makes the filter response insensitive to the phase jump.

Referring back to FIG. 1, there is also provided in the system a conventional filter. This is preferably an infinite impulse response (IIR) two-pole band pass digital filter 44. The output of this filter is level detected in a level detector 46, and when it exceeds a threshold level indicating that the input rate code signal to which the filter 44 is tuned has been detected, a timer 48 is started. At the end of the time out of the timer, an enable signal is generated. The response of the filter is such that its output exceeds the threshold level after approximately four cycles of the code rate.

There is also provided a reconstruction buffer register 50 having N sample or element locations. The elements or samples of the input rate code signal are also applied to this buffer. The IIR filter 44 and the reconstruction buffer register 50 are used to speed up the pickup rate of the phase insensitive filter system provided by the multipliers 12 and 14 and the cross-correlation low pass filters 16–22 as well as to give the filter system improved immunity to phase shifts which occur in rapid succession. These are double phase shifts which occur within the N sample times, where N is the number of samples for 8 cycles of the rate code signal. This is the same capacity as the buffers in the N sample low pass filters 16 and 20.

The buffer 50 holds the previous input signal history and the phase of the input signal can be determined from this data. The address logic 52 is used to create a replica of the input signal in the reconstruction buffer based upon the four most recent cycles of data stored in the reconstruction buffer 50. This replica of the input signal is in phase with the actual input signal and represents a previous history of sixteen good cycles of input data with no phase jumps, although the actual previous sixteen cycles may have contained phase jumps or may not have been at the proper frequency. The address logic 52 is enabled when the IIR filter 44 produces a signal indicating that a valid rate code has been acquired. This may, for example, be a level detected in the level detector which is approximately 55% of the maximum output of the filter 44. The enable signal is then delayed in the timer 48 by a period of one second to provide the desired pick up response of the phase insensitive filter system. The samples in the reconstruction buffer register are available before the phase insensitive portion of the system has picked up (i.e., when the level of the output from the sum circuit 36 has reached the pre-determined threshold established in the level detector 38). The latter pickup time may be 4 or 5 times as long as required for the IIR filter 44 to pick up and reach the threshold level and produce the enable signal from the timer 48. However, the fact that the IIR filter 44 has picked up indicates the presence of a valid signal. This information is used to cause the phase insensitive filter system to pick up much faster. In other words, what happens is that the reconstruction buffer 50 contains a record of the input signal. This record may be the equivalent of 16 cycles of valid input rate code. When the IIR filter 44 picks up, it is known that at least the most recent four cycles of data in the reconstruction buffer represent four good cycles of code because otherwise the IIR filter could not have picked up. We only really care about the four most recent good cycles. Therefore we can disregard the other 12 cycles of information in the reconstruction buffer. However if that 12 cycles of data is left as is, the phase insensitive system will not have sufficient output level when we switch over to it. In order to overcome this problem, the most recent four cycles in the reconstruction buffer are examined to determine the phase of the signal. Knowing the phase, the remaining 12 cycles of the reconstruction buffer can be filled with a dummy input signal, which is in the phase with the most recent four cycles in the buffer. When this is done, the reconstruction buffer contains 16 good cycles of input signal. It also contains no phase jumps, and it is in phase with the actual signal coming from the track. In short, it looks like the previous history had been 16 good input cycles instead of just four. When the switch over to the data from the reconstruction buffer 50 cross-correlation is made to the phase insensitive filter buffers 16 to 22, it picks up to its maximum output level and holds.

Upon occurrence of the enable output from the timer 48, the address logic 52 enables the reconstruction buffer register to write the intitial samples (for 4 code cycles in this example) in all the N sample locations in the buffer 50 in phase with the most recent samples, since we do not wish to create a phase jump in the buffer 50. The buffer then simulates a valid, actual input rate code signal. The reconstruction buffer samples are then read out into the multipliers 12 and 14 of the phase insensitive filter system. The rate at which readout from the reconstruction buffer 50 occurs may be greater than the sample rate. New samples from the sampler 10 are read into the reconstruction buffer 50 at one end, and old samples at the opposite end of the buffer are deleted. The reconstruction buffer 50 can then be used continuously, and read out into the phase insensitive filter system.

In other words, samples are put into the reconstruction buffer 50 at the sample rate. When it is determined that the contents of the reconstruction buffer are needed either to bring up the phase insensitive filter or to overcome a double phase jump, the contents of the reconstruction buffer are rapidly modified as described previously to represent a history of 16 good signals in phase with the input signal. The contents of the reconstruction buffer are then fed into the multipliers and the phase insensitive filter algorithm is run 2N times very rapidly. The result is that the buffers of the low pass filters (16, 18, 20, 22) are filled with information representing 16 good input cycles in phase with the input signal. This latter process occurs very rapidly. In fact it all is done in less than one sample time. And again it only occurs whenever it is determined that reconstruction is needed either to bring up the phase insensitive filter rapidly or to avoid a double phase jump. The normal operation of the reconstruction buffer is as a simple shift register. As each new input sample is taken, it is put into the reconstruction buffer at one end and the least recent sample falls out at the other. This operation occurs every sample period. Reconstruction occurs only as required.

The reconstruction buffer also provides the immunity of the system to double phase jumps. The IIR filter 44 is sensitive to phase jumps. Whenever the output level therefrom drops below a specified level, two possible events have occurred, namely either a phase jump has just occurred or a valid input rate code signal is no longer present. In the latter case, the output signal from the IIR filter 44 will remain below the specified pickup level and the enable output will disappear; thus inhibiting the relay driver 40. The relay driver is inhibited, therefore, when a valid rate code signal is not present.

In the event of a phase jump, the output of the IIR filter 44 begins to increase shortly after the phase jump. When the IIR filter reaches the pickup level and the enable signal is again produced, the occurrence thereof enables the address logic 52. The address logic then operates the reconstruction buffer to reconstruct the replica of what is stored in the initial locations therein throughout the buffer. Accordingly, samples of the input rate code signal are available through the phase jump, even if a second phase jump occurs before N cycles of the code rate have occurred. The system is therefore invulnerable to a double phase jump unless it occurs before the IIR filter 44 can build up its output back to the pickup point (the threshold level determined by the detector 46); an unlikely occurrence, since only a few cycles, for example between 6 and 7, of the rate code signal are needed for the IIR filter 44 to build up its output to maximum level. It will therefore be apparent that the rate decoding system is capable of operating rapidly to acquire and maintain the acquisition of the rate code signal.

From the foregoing description, it will be apparent that there has been provided an improved rate code decoding system and an improved phase insensitive filter, which are especially adapted for use therein. Variations and modifications in the herein described system and in the filter, within the scope of the invention, will undoubtedly suggest themselves skilled in the art. Accordingly, the foregoing description should be taken as illustrative and not in a limiting sense.

I claim:

1. In a railway signaling system wherein control signals are generated in response to different rate code signals transmitted, an improved rate code decoding system which is insensitive to differences in phase between rate code signals of like rate code in the adjacent track circuits, said decoding system comprising means for obtaining separate correlation outputs of said rate code signals separately with reference signals of like frequency which are in quadrature phase relationship with each other and with a step function, means for summing the correlation outputs to provide a constant output when said rate code signal is present regardles of phase shift therein, means for deriving said control signal from said summing means output, and means operable upon each of said separate outputs to provide the absolute values thereof, and said summing means being operable to sum the absolute values of said separate outputs to provide said constant output.

2. In a railway signaling system wherein control signals are generated in response to different rate code signals transmitted, an improved rate code decoding system which is insensitive to differences in phase between rate code signals of like rate code in the adjacent track circuits, said decoding system comprising means for obtaining separate correlation outputs of said rate code signals separately with reference signals of like frequency which are in quadrature phase relationship with each other and with a step function, means for summing the correlation outputs to provide a constant output when said rate code signal is present regardless of phase shift therein, means for deriving said control from said summing means output, said correlation output obtaining means comprising means for multiplying said rate code signals separately with first and second ones of said reference signals which are in quadrature phase relationship to provide first and second product outputs, and means for cross-correlating said first and second product outputs with said step function to provide said separate correlation outputs as first and second correlation outputs, said cross-correlation means for said first and second product outputs each including buffer means for storing successive groups of successive elements of the one of said first and second product outputs applied thereto, means for providing a running sum of the elements in said buffer means, the value of which represents the maximum correlation between said elements in said buffer means and the step function, and the absolute values of said running sums for each of said successive groups representing said correlation outputs, said running sum producing means comprising means for initializing a variable ($X_{out}$) having an absolute value equal to the running sum ($X_{sum}$) of the elements in said buffer means, means for initializing a second variable ($X_{temp}$) having the same value as said initialized value of said $X_{out}$ variable, means responsive to the sign of each successive element and successively for each of said elements operable to increment or decrement (depending upon the sign of each element) said $X_{temp}$ variable twice to obtain a new absolute value of said $X_{temp}$ variable, means for comparing said new absolute value of said $X_{temp}$ variable with the absolute value of said $X_{out}$ variable, and means responsive to said comparing means for replacing said $X_{out}$ variable with said $X_{temp}$ variable to provide a new $X_{out}$ variable when the absolute value of said new $X_{temp}$ variable is greater than the value of said $X_{out}$ variable, the final value of said $X_{out}$ variable obtained after response for each of said groups of elements being said value which represents said maximum correlation.

3. The improvement according to claim 2 wherein said cross-correlation means includes other buffer means for correlating said first and second intermediate outputs with said step function, each of said other buffer means having storage for more elements of said intermediate elements than said first named buffer means, each of said other buffer means also having means for providing output representing the running sum of the elements therein, the absolute value of which represents the maximum correlation between said elements therein and said step function, means for summing said outputs from said other buffer means to provide an enabling output, and means for enabling the utilization of the correlation outputs from said first named buffer means in response to said enabling output when it is at least of a predetermined level.

4. A phase insensitive filter system for input signals within a certain frequency band which comprises means for obtaining separate correlation outputs of said input signals with reference signals of like frequency which are in quadrature phase relationship with each other and with a step function, means for summing the correlation outputs to provide an output representing said input signal when it is within said frequency band regardless of phase shift therein, means operable upon said correlation outputs to provide the absolute values thereof, and said summing means being operable to sum the absolute values of said correlation outputs to provide said filter output signal.

5. A phase insensitive filter system for input signals within a certain frequency band which comprises means for obtaining separate correlation outputs of said input signals with reference signals of like frequency which are in quadrature phase relationship with each other and with a step function, means for summing the correlation outputs to provide an output representing said input signal when it is within said frequency band regardless of phase shift therein, said correlation output obtaining means comprising means for multiplying said input signals separately with first and second reference signals which are in quadrature phase relationship to provide first and second product outputs, means for cross-correlating said first and second product outputs with said step function to provide said separate correlation outputs, said cross-correlation means for said first and second intermediate outputs each also including buffer means for storing successive elements of each of said intermediate outputs, means for providing a running sum of the elements in said buffer means, the value of which represents the maximum correlation between said elements in said buffer means and the step function, the absolute values of said running sum representing said correlation outputs, said running sum providing means comprising means for initializing a variable ($X_{out}$) having an absolute value equal to the absolute value of said running sum ($X_{sum}$) of the elements in said buffer means, means for initializing a second variable ($X_{temp}$) having said initialized value of said $X_{out}$ variable, means responsive to the sign of each of said successive elements and successively for each of said elements operable to increment or decrement (depending upon the sign of each element) said $X_{temp}$ variable twice to obtain a new absolute value of said $X_{temp}$ variable, means for comparing said new absolute value of said $X_{temp}$ variable with the absolute value of said $X_{out}$ variable, and means responsive to said comparing means for replacing said $X_{out}$ variable with said $X_{temp}$ variable to provide a new $X_{out}$ variable when the absolute value of said new $X_{temp}$ variable is greater than said absolute value of said $X_{out}$ variable, the final value of said $X_{out}$ variable obtained after response for each of said groups of elements being said value which represents said maximum correlation.

6. The filter system according to claim 5 wherein said cross-correlation means includes other buffer means for correlating said product outputs with said step function, each of said other buffer means having storage for more elements of said intermediate outputs than said first named buffer means, each of said other buffer means also having means for providing outputs representing the running sum of the elements therein, the absolute value of which represents the maximum correlation between said elements therein and said step function, means for summing said output sum said other buffer means to provide an enabling output, and means for enabling the utilization of the correlation outputs from said first name buffer means to provide said filter output in response to said enabling output when said enabling output is at least of a predetermined level.

* * * * *